United States Patent [19]

Berthon et al.

[11] Patent Number: 4,876,540

[45] Date of Patent: Oct. 24, 1989

[54] SYSTEM FOR CONTROLLING METERED PARKING

[75] Inventors: Patrick Berthon, Besancon; Christian Guion, Verrieres Le Buisson, both of France

[73] Assignee: Flonic, Montrouge, France

[21] Appl. No.: 235,785

[22] Filed: Aug. 22, 1988

Related U.S. Application Data

[63] Continuation of Ser. No. 870,554, Jun. 4, 1986, abandoned.

[30] Foreign Application Priority Data

Jun. 7, 1985 [FR] France ..... 85 08608

[51] Int. Cl.[4] ..... G08G 1/00

[52] U.S. Cl. ..... 340/932.2; 368/90; 194/902

[58] Field of Search ..... 340/51, 309.15, 932.2; 368/90; 364/467, 464.01; 235/378, 384; 194/900–902

[56] References Cited

U.S. PATENT DOCUMENTS

| | | | |
|---|---|---|---|
| 3,760,160 | 9/1973 | Gieringer et al. | 194/902 X |
| 4,228,519 | 10/1980 | Pfeifer . | |
| 4,310,890 | 1/1982 | Trehn et al. | 340/51 X |
| 4,356,903 | 11/1982 | Lemelson et al. | 340/51 X |
| 4,379,334 | 4/1983 | Feagins, Jr. et al. | 368/90 X |
| 4,495,617 | 1/1985 | Ampulski et al. . | |
| 4,561,092 | 12/1985 | Shaver . | |
| 4,576,273 | 3/1986 | Milnes | 368/90 X |
| 4,596,982 | 6/1986 | Bahr et al. . | |

FOREIGN PATENT DOCUMENTS

| | | | |
|---|---|---|---|
| 0142394 | 12/1984 | European Pat. Off. . | |
| 2148035 | 5/1985 | United Kingdom | 368/90 |
| 8100778 | 3/1981 | World Int. Prop. O. | 368/90 |

*Primary Examiner*—Joseph A. Orsino
*Assistant Examiner*—Brian R. Tumm
*Attorney, Agent, or Firm*—Sanford J. Asman

[57] ABSTRACT

A system for controlled meter parking of road vehicles comprising a parking meter and a portable terminal for use by a checker of the controlled meter parking. A keyboard allows drivers to enter vehicle data. A parking time limit is calculated as the function of the amount of money paid. The parking meter then stores pairs of data items, where each pair contains a vehicle data item and an associated parking time limit. In one embodiment, the amount of money is read from a memory card to allow the driver to receive credit for any time not used upon return to pick up the car. The system includes a clock for comparison with the parking time limits. When the comparison with the clock indicates that a parking time limit has expired, the associated pair of data items are deleted from the parking meter memory. A portable terminal allows a checker to enter identification data corresponding to a vehicle actually parked in one of the parking spaces. If there is no identification data in the parking meter memory corresponding to the data entered by the checker, a warning signal goes off on the portable terminal to alert the checker that the vehicle is in violation. Further, if the checker determines that the parking time limit in the portable terminal memory has expired by comparing that limit with a clock in the portable terminal, the warning signal all goes off.

36 Claims, 4 Drawing Sheets

SYSTEM FOR CONTROLLING METERED PARKING

This application is a continuation of application Ser. No. 06/870,554, filed on June 4, 1986, now abandoned entitled A SYSTEM FOR CONTROLLING METERED PARKING.

The present invention relates to a system for controlling metered parking.

BACKGROUND OF THE INVENTION

More precisely, the invention relates to a system for controlling metered parking in such a way as to simplify parked vehicle checking by accelerating the ability of checkers (e.g. "parking wardens") to spot vehicles parked in violation, e.g. parked vehicles for which the parking fee has not been paid, or for which an insufficient fee has been paid, or vehicles which are parked in a no parking area.

It is widely known that payment for vehicle parking on the public highway as a function of time has become common practice, particularly in large cities. In other words, in order to leave a vehicle parked for a certain length of time, the driver must pay a given fee in order to be properly authorized to park.

A first metered parking system consists in placing parking meters in the sidewalk in physical proximity to parking spaces, and in the driver inserting coins in a meter corresponding to the parking space used in order to pay for a desired length of parking time. The meter includes a mechanism which displays a moving indicator to show the amount of paid-for parking time remaining. It is simple to check such a metered parking system insofar as the checker merely has to observe the position of the time-remaining indicator in order to find out whether the vehicle occupying the corresponding parking space is in violation. A major drawback of this type of metered parking system is that each meter-emplacement can control a maximum of only two parking spaces, with each space having a specific meter mechanism corresponding thereto.

In order to remedy this drawback, systems have been developed in which a single meter-emplacement can control parking over a much larger number of parking spaces. As before, a driver wishing to park in one of the spaces controlled by a given meter, inserts coins into the meter in order to pay for a desired parking time. The meter then issues a slip which specifies the end of the paid-up parking time. The driver must then place the slip on the vehicle in such a manner as to make it easily checkable by a checker, for example the slip may be placed immediately behind the windscreen. In order to check whether a vehicle is in violation, a checker must therefore read the information marked on the slip which is placed behind the vehicle windscreen. This takes a relatively long time since the checker must begin by finding the slip whose exact position cannot be known in advance, and must then read the information printed thereon, which information is not always perfectly printed. In addition, the checker must scrutinize the slip relatively carefully if there is to be any chance of detecting counterfeit or altered slips.

In order to remedy these defects, a first aim of the present invention is to provide a system for controlling metered parking of the type comprising at least one parking meter associated with a plurality of parking spaces in such a manner as to allow a checker to check the status of parked vehicles without having to read slips displayed on the parked vehicles.

A second aim of the invention is to provide a system for controlling metered parking of the above type which makes it possible for drivers to pay for the amount of time they have actually left their vehicles parked, rather than for the total length of prepaid time.

SUMMARY OF THE INVENTION

The first aim of the invention is achieved by a parking control system which comprises:

a parking meter for controlling a plurality of parking spaces, said meter comprising means accessible to drivers for entering vehicle indentity data and a parking time limit as a function of an amount of money prepaid, means for storing pairs of data items corresponding to a vehicle identity and to an associated parking time limit, and a clock for delivering data concerning the present time; and a portable terminal for use by a checker, said terminal including means accessible to said checker for entering identification data corresponding to a vehicle actually parked at one of said parking spaces;

said system further including means for comparing the identity data entered into said portable terminal with the identity data stored in said parking meter, means for comparing said stored parking time limit data with the present time as delivered by said clock, and means for processing the results of said comparisons in order to cause a warning signal to appear at said terminal when a parked vehicle whose identity data has been entered into said terminal is in violation.

It will readily be understood that the time required for detecting violating vehicles is very considerably reduced, since the checker merely has to key in to the portable terminal information which identifies a given vehicle, for example its registration number or a portion thereof, and the checker is informed almost immediately whether the vehicle is in violation.

In a preferred implementation of the present invention, which enables the second aim of the invention to be achieved, the parking meter further includes parking time prepayment means comprising a reader for a data medium which includes money data and identity data of the data medium holder's vehicle, means actuated in response to a desired parking time to subtract the fee corresponding to said parking time from the data medium when a driver parks a vehicle, and means operable when the driver wishes to remove the vehicle for adding any remaining balance fee to the data medium if the prepaid time has not been fully utilized.

BRIEF DESCRIPTION OF THE DRAWINGS

Embodiments of the invention are described by way of example with reference to the accompanying drawings, in which.

DETAILED DESCRIPTION OF PREFERRED EMBODIMENTS

Figure 1:
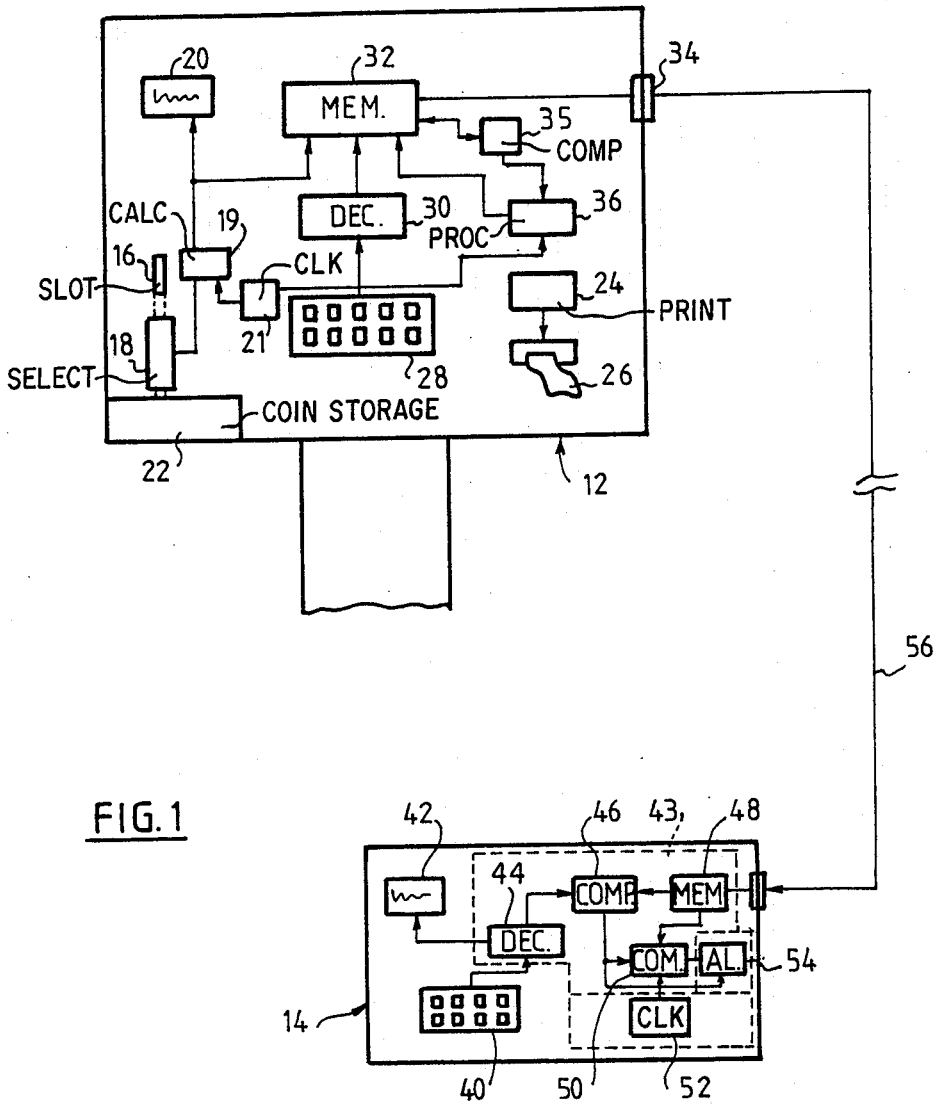
FIG. 1 is a block diagram of a first implementation of a system for controlling metered parking, in accordance with the invention.

Reference is made initially to FIG. 1 while describing a first implementation of a system for controlling metered parking. The system is essentially constituted by a parking meter 12 placed on the sidewalk in order to control a plurality of parking spaces disposed along said sidewalk, together with a portable terminal 14 which is carried by a checker employed to check on the vehicles parked in the area under the control of the parking meter 12.

In a conventional manner, the meter 12 includes a slot 16 through which coins are inserted to make up a total amount of money which determines the parking time paid for. The coins inserted into the slot 16 are checked by a coin selector 18 which determines the amount actually inserted through the slot 16. A calculator 19 determines the time at which paid up parking expires on the basis of said total amount of money inserted through the slot 16 and the present time as delivered by a clock circuit 21. The end of parking time is displayed on a display panel 20. Naturally, after passing through the coin selector 18, the coins are stored in a receptacle 22. The meter 12 also includes, in conventional manner, printer means 24, e.g. of the thermal head type, suitable for dispensing a printed slip 26 to the driver, with the slip indicating the amount paid and the time at which parking expires. However, it must be emphasized that in accordance with the invention, the slip 26 serves merely as a receipt for the payment made by the driver, although it may also serve to remind the driver of the parking time limit. The slip 26 is not used in any way for actually checking whether vehicles are in violation, as appears from the following description.

The meter 12 further includes a keyboard 28 enabling the driver, prior to inserting money into the slot 16, to key data into the meter suitable for identifying the parked vehicle. This identification data may be constituted by the full registration (or license) number of the vehicle or merely by a portion thereof, or else by a number identifying the parking space where the vehicle has been left, in which case each parking space must be marked out and labelled with a number. The data inserted via the keyboard 28 is decoded by a decoder 30 and stored in a memory circuit 32. The memory circuit 32 also serves to store the parking time limit for said vehicle (as taken from the calculator 19) in conjunction with the vehicle identity data. Thus, the memory 32 stores data items in pairs, with each pair being constituted by vehicle identity data and by a time limit on authorized parking. The parking meter also includes external means referenced 34 to enable the data stored in the memory 32 to be read from outside the meter.

Finally, the parking meter includes a circuit 35 for reading time data contained in the memory 32. This data is read periodically and a circuit 36 compares the time data as read with the present time data as delivered by the clock 21. If the present time is later than the time data read in the memory (by more than a predetermined period of grace, e.g. (three minutes), then the circuit 36 deletes the time data as read from the memory 32 together with the vehicle identity data. It will thus be understood that the pairs of data items stored in the memory 32 correspond to properly parked vehicles to within the accuracy of the frequency with which the memory is read (and taking account of the period of grace).

A checker employed to check parking carries a portable terminal 14, and this terminal also includes a keyboard 40 for entering data into the terminal, together with a display panel 42 for temporarily displaying the data entered from the keyboard 40. The terminal 14 further includes a microprocessor 43 whose functions may be considered as including a decoder 44 for decoding data entered via the keyboard 40, and a comparator 46 for comparing the data delivered by the decoder 44 with data stored in a main memory 48. The storage of data into said main memory 48 is described below. The microprocessor also includes second comparator means 50 for comparing data stored in the main memory 48 with present time data as delivered by a clock circuit 52. The result of this comparison may be used to control an alarm circuit 54.

The portable terminal 14 is used as follows: when the checker wishes to check on vehicles parked in the zone controlled by the parking meter 12, the checker connects the portable terminal 14 to the parking meter 12 in order to copy the entire contents of the data stored in the memory 32 of the meter 12 into the main memory 48 of the terminal 14. The data may be conveyed via a connection system 34 on the meter together with a temporary wire connection represented by line 56. Once the checker has copied the entire data contained in the memory 32 into the main memory 48 of the terminal, i.e. all the data relating to vehicle identity and to vehicle parking time limits, the checker merely has to pass in front of each parked vehicle and key in the vehicle identity via the keyboard 40. The comparator 46 then compares this newly keyed-in data with the identity data contained in the memory 48. If the keyed-in identity data does not appear in the memory 48, then the driver of that vehicle has either made no payment at all towards parking in that parking space, or else has made payment for a period of parking which has expired (by longer than the period of grace and at the moment that data was copied into the main memory 48 of the portable terminal). The comparator 48 then sends a signal to the comparator 50 which in turn sets off the alarm circuit 54. The alarm circuit 54 can then cause a special sign to appear on the display panel 42 next to the identity number which has just been keyed in. Otherwise, the keyed-in identity data is to be found in the data stored in the memory 48, thereby causing the comparator 46 to detect identity between the keyed-in data and the stored data and this data coincidence will cause the comparator 50 to compare the parking time limit associated with said identity data and the present time data as delivered by the clock 52. So long as the parking time limit is later than the present time data, the vehicle is properly parked. In contrast, if the parking time limit is earlier than the present time (by more than the period of grace), the comparator 50 sets off the alarm circuit 54 which in turn displays a conventional symbol on the display panel 42 to indicate that the vehicle is in violation.

It will be understood that it is necessary to make a time comparison at the terminal itself because of the time which may elapse between the moment at which data is read from the memory 32 in the meter 12 and the instant at which the checker actually passes in front of the vehicle whose parking is to be checked.

Instead of using keyboards 28 and 40, the meter 12 and the portable terminal 14 could be fitted with other data entry means, for example they could be fitted with voice-operated control devices capable of recognizing a limited number of instructions defined in advance.

Similarly, the data stored in the memory 32 of the parking meter need not necessarily be copied into the main memory 48 of the portable terminal by means of a wire link, and various other kinds of link are possible such as an infrared link or a link using any other kind of radiation capable of transmitting coded data. In such a case, the meter 12 is fitted with an infrared transmitter/-receiver which is capable of being remotely activated, and the terminal 14 is similarly provided with an infrared transmitter/receiver for activating the parking meter transmitter and for receiving coded signals delivered by the parking meter transmitter. One such system is described in European patent number 142,394.

Figure 2:
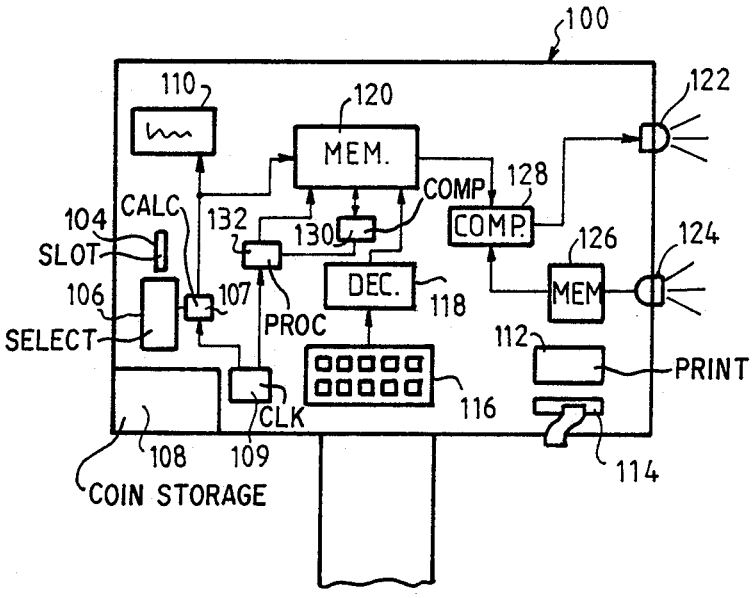
FIG. 2 is a block diagram of a second implementation of a system for controlling metered parking in accordance with the invention.
Figure 2:
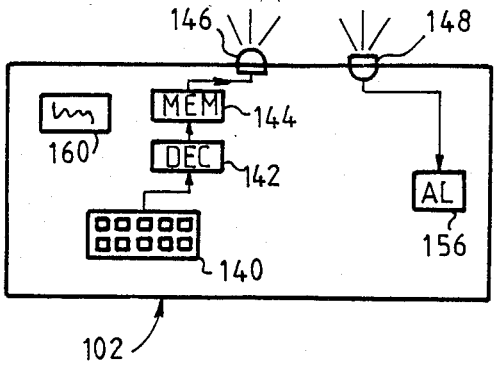

A second embodiment of the invention is described with reference to FIG. 2. In this case, the system comprises a parking meter 100 and a portable terminal 102. The parking meter 100 has a coin slot 104, a coin selector 106 and a receptacle 108 for collecting coins. It also includes a display panel 110, a printer system 112, and a slot 114 for dispersing printed slips. In accordance with the invention, the parking meter 100 further includes a keyboard 116 similar to the keyboard 28 of the FIG. 1 embodiment to enable drivers to key data into the parking meter, and in particular to enable them to key in vehicle identity data. The output from the keyboard 116 is connected to a decoder 118 which is in turn connected to a memory circuit 120 which is also connected to the output from the coin selector 106. As in the FIG. 1 embodiment, the memory 120 contains pairs of data items constituted by an item identifying a parked vehicle whose identity has been keyed in via the keyboard 116, and an item concerning the corresponding parking time limit. The parking time limit item is generated by the calculator circuit 107 which receives both the signal delivered by the coin selector 106 and present time data delivered by a clock circuit 109. In this embodiment, the parking meter further includes a radio transmitter 122, capable of transmitting data outside the parking meter. The meter also includes a radio receiver 124 permanently capable of entering data into the parking meter as received from the portable terminal 102 in a manner described below. The output from the receiver 124 is connected to a buffer memory 126 which is connected in turn to a comparator 128 whose other comparator input is connected to the memory 120. The comparator 128 may cause the transmitter 122 to transmit a warning signal.

As in the FIG. 1 embodiment, the parking meter 100 includes a circuit 120 for periodically reading the time data contained in the memory 120 and a comparator circuit 132 for comparing the time data read in said memory with present time data as delivered by the clock 109. If the present time data is later than the time data read from the memory by more than a period of grace, the comparator circuit causes the corresponding time data item and its associated vehicle identity data item to be deleted from the memory 120. Consequently, at any given instant, the memory 120 contains pairs of data items which relate solely to properly parked vehicles (taking account of the period of grace).

Reference is now made to the portable terminal 102 which is used by the checker for checking whether parking has been paid for. This portable terminal includes a keyboard 140 for inserting data into the terminal, and in particular for inserting vehicle identity data into the terminal. The output from the keyboard 140 is connected to a decoder 142 capable of storing a data item entered from the keyboard 140 into a storage memory 144. The storage memory 144 is connected to a radio transmitter 146 and the signal transmitted by the transmitter 146 is capable of being received by the receiver 124 of the parking meter 100. The terminal 102 also includes a radio receiver 148 capable of receiving the signal transmitted by the transmitter 122 of the parking meter 100. The signal received by the receiver 148 is used to control a warning circuit 156.

The system shown in FIG. 2 operates as follows: each driver who wishes to leave a vehicle in a parking space controlled by the parking meter 100 must enter vehicle identity data into the parking meter via the keyboard 116, with such data being constituted, for example, by the vehicle registration number, or a portion thereof, or by the number of the parking space occupied by the vehicle. The driver must also insert coins into the slot 104 up to an amount corresponding to the desired parking time. This pair of data items is stored in the memory 120. When a checker wants to check whether vehicles parked in a zone controlled by the parking meter 100 are in violation, the checker uses the keyboard 140 to key in the identify of the vehicle being checked.

This identity data is stored in the memory 144 and corresponding data is transmitted by the transmitter 146 to the parking meter 100. On being received by the receiver 124, this data is temporarily stored in the memory 126. The arrival of this data in the memory 126 causes the comparator 128 to compare this data in the memory 126 with the set of vehicle identity data items contained in the memory 120. If the corresponding vehicle identity data item is indeed present in the memory 120, the transmitter 122 does not transmit a signal, since the vehicle is properly parked. Alternatively the transmitter may transmit a special signal which is received by the receiver 148 to cause a symbol indicative of proper parking to be displayed on the terminal 102.

If the identity data stored in the memory 126 is not to be found in the identity data items stored in the memory 120, i.e. if the corresponding vehicle is in violation, this situation is detected by the comparator 128 and the transmitter 122 send a warning signal to the terminal 102. This signal is received by the receiver 148 and is used directly to activate a warning circuit 156.

It can be seen that this second embodiment is even easier to use for a checker since there is no need to load the portable terminal with data before proceeding to check the vehicles. Naturally, it is important to use a mode of data transmission between the parking meter and the portable terminal which is compatible with the surrounding conditions in any given case. For this purpose, the radio transmissions may be performed in the 150 MHz band.

It will also be understood that it is not necessary in this embodiment to perform comparisons with the present time in the terminal itself, since the information in the memory of the parking meter 100 is read at the moment when the checker is in front of a vehicle to be checked, by virtue of the radio link between the parking meter and the terminal. It must be emphasized that in this embodiment the system includes a process whereby time limits for authorized parking are compared with present time, but that this comparison is performed automatically in the parking meter itself, without any intervention on the part of the checker.

Figure 3:
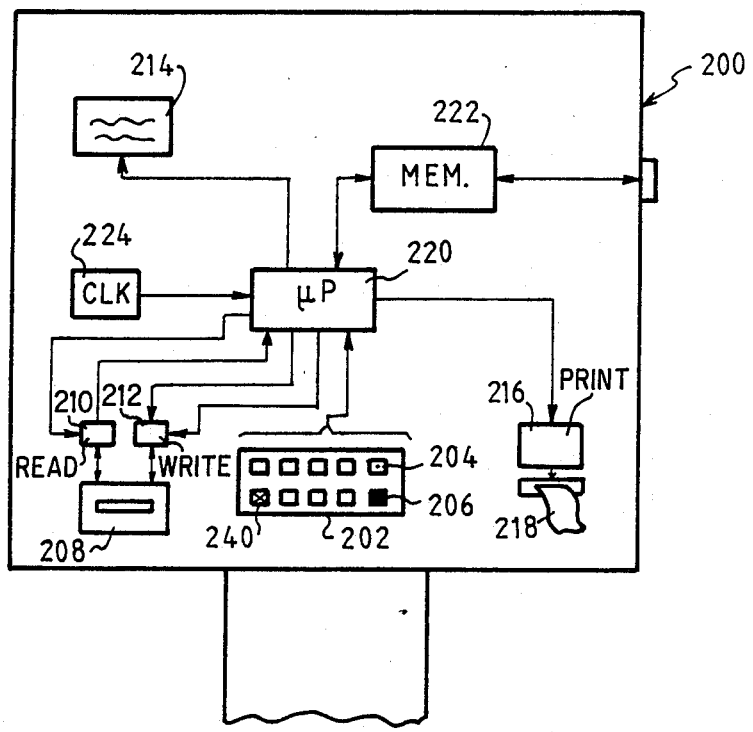
FIG. 3 is a block diagram of a variant of the first implementation, and suitable for use with memory cards.

FIG. 3 shows a parking meter 200 suitable for operating with memory cards. The parking meter 200 is of the type shown in FIG. 1. The portable terminal associated with the parking meter 200 is therefore identical with the portable terminal shown in FIG. 1 and it is not described further.

The parking meter 200 includes a keyboard 202 for receiving alphanumeric data. The keyboard includes an additional key 204 which is pressed when a driver wants to begin parking and a key 206 which a driver presses when parking is to end. The meter 200 also includes a card reader 208 (for use with cards having a magnetic memory in the present case), together with a read control circuit 210 and a circuit 212 for writing data on the magnetic track of the card; a display panel 214; a printer system 216 for delivering a slip with an indication of the amount paid for parking and possibly also with an indication of the parking time limit; and a microprocessor 220 together with its associated memory 222.

The microprocessor 220 has inputs connected to receive the signals delivered by the keyboard 202, including the special keys 204 and 206, together with information read by the read circuit 210. Outputs from the microprocessor control the display panel 214, the read and write control circuits 210 and 212, and the printer circuit 216. The microprocessor also delivers the data which is to be written on the magnetic track of the card via the control circuit 212. Naturally, the microprocessor 220 is connected to its associated memory 222. Finally, the microprocessor receives a time signal from a clock circuit 224.

A driver seeking to use this metered parking system must initially process a magnetic parking card. This card has a magnetic track with two data storage zones: a first zone for receiving vehicle identification data and card validity data (city, duration, etc.); and a second zone for receiving the amount of money available for paying parking fees. When the card is purchased, the first zone only includes card validity data, and the second zone includes data which corresponds to the purchase price of the card. When a driver wants to park, the card is inserted into the card reader 208 and the start of parking key 204 is pressed. The reader reads the contents of the first memory zone by means of the circuit 210. If there is no vehicle identity data in this zone, the microprocessor 220 causes the display panel 214 to display an instruction inviting the driver to key in vehicle identity data which is then recorded on the first zone of the magnetic track after the driver has been given a chance to verify the data. This information is the vehicle registration number. The driver then keys in the desired parking duration. This duration is converted into an amount which is compared with the amount recorded in the second zone of the card's magnetic track. If the amount of money remaining on the card is less than the amount needed to pay for the desired parking duration, the microprocessor 220 causes the panel 214 to display the maximum possible length of stay, given the amount of money remaining on the card. If the amount of money remaining on the card is greater than the amount required to pay for the desired length of stay, the panel 214 is caused to display the amount required to pay for parking. If the driver is satisfied with the displayed data, a validation key 240 should be pressed. The microprocessor then calculates the difference between the amount read on the magnetic track and the amount corresponding to the desired length of stay. The write circuit 212 is caused to delete the previous amount from the magnetic track and to write the difference which has just been calculated. The microprocessor transfers the identity data into its memory 222 as read from the card or as keyed in, and it also transfers the time limit on the authorized period of parking. The card is then returned to the driver. The microprocessor 220 then proceeds at predetermined intervals to read the time data items recorded in its memory 222 and to compare them with a present time data item as delivered by the clock 224 (with allowance being taken of a period of grace as for the embodiments described with reference to FIGS. 1 and 2). The pairs of data items which correspond to vehicles staying beyond the end of their paid-for period of parking are thus deleted from the memory 222.

When a driver returns to take away the vehicle, two situations may arise. Either the driver returns late and the vehicle is already in violation, or else the driver returns early and is authorized to recover any excess payment. In order to do this, the driver inserts the card into the card reader 208 and presses on the end-of-parking special key 206. The read circuit 210 sends the identity data read from the card to the microprocessor 220. The microprocessor 220 looks for this identity data in its memory 222 and retrieves the corresponding time limit on authorized parking. It compares this time limit with the present time as delivered by the clock circuit 224, and calculates the difference between the amount actually paid for parking and the amount which corresponds to the parking time actually used. The microprocessor 220 causes the reader to read the amount recorded on the magnetic track of the card and it adds in the difference amount of money. The sum of the amount read from the card and the difference is then written back to the card using the write circuit 212. The driver can then retrieve the card. It can thus be understood that the amount actually deducted from the card corresponds to the amount of time for which the vehicle is, in fact, parked.

In the preceding example, the card was assumed to have a magnetic track. Naturally, other forms of electronic memory card could be used, instead. The important requirement is that the card should have enough memory locations to receive successive amounts of money.

In addition, a parking meter may be equipped both with a coin selector as in the FIG. 1 and with a card reader as in the FIG. 3 embodiment.

The memory 222 in the parking meter 200 contains exactly the same data as is stored in the memory 120 of the parking meter 100 or in the memory circuit 32 of the parking meter 12. Consequently, the portable terminal associated with the parking meter 200 shown in FIG. 3 may be identical with the terminal 14 shown in FIG. 1 or with the terminal 102 shown in FIG. 2, depending on the data transmission means provided at the terminal 200.

The meter described above with reference to FIG. 3 may be modified slightly to operate differently with a magnetic memory card of the above-described type. In this slightly different implementation, the parking meter includes a keyboard with alphanumeric keys only. The keyboard is used solely on the first occasion that a card is inserted in order to write the vehicle identity data thereon.

When a driver now parks a vehicle in the zone controlled by the parking meter, the magnetic card is inserted into the card reader and the parking meter processor circuit determines the maximum authorized parking time limit by adding a maximum parking period (e.g. two hours) to the present time. The data is stored in the memory 222 together with the identity data. The total amount of money remaining on the card is reduced by the amount required to pay for the maximum length of authorized parking.

When the driver wants to take the vehicle away from its parking space, two possible situations may arise: either the driver returns after the maximum duration has expired and the vehicle is in violation; or else the driver returns before the maximum duration has expired and can therefore be repaid the excess amount pre-paid in the manner described with reference to FIG. 3. In other words the amount remaining on the card memory is increased by an amount corresponding to the unused parking time.

Consequently, if the driver inserts a card after the maximum authorized parking duration has expired, the parking meter interprets the insertion as the beginning of a new parking period and deducts the corresponding amount.

It can thus be seen that in this implementation card insertion performs two functions simultaneously: it informs the parking meter of the identity of the vehicle, and it causes the time limit on authorized parking to be inserted.

The advantages of a metered parking control system in accordance with the invention can clearly be seen from the above description. For the driver, there is no need to return to the vehicle after taking a slip from the parking meter. In addition, if a memory card is used, then payment is effected only for the time actually parked.

For the organization controlling the metered parking spaces, there are even greater advantages. The time required to check whether a vehicle is in violation, is greatly reduced. For a given checker workforce, this means that vehicles are checked more frequently, thereby increasing the dissuasive effect of employing checkers. This improves the return on the metered parking installation. Since the slips issued are no longer used for checking whether a vehicle is in violation, there is no longer any problem with slips being falsified. The data stored in parking meters may be sampled periodically for statistical purposes and for improving the relationship between the fee to be paid as a function of the desired parking time.

Figure 4:
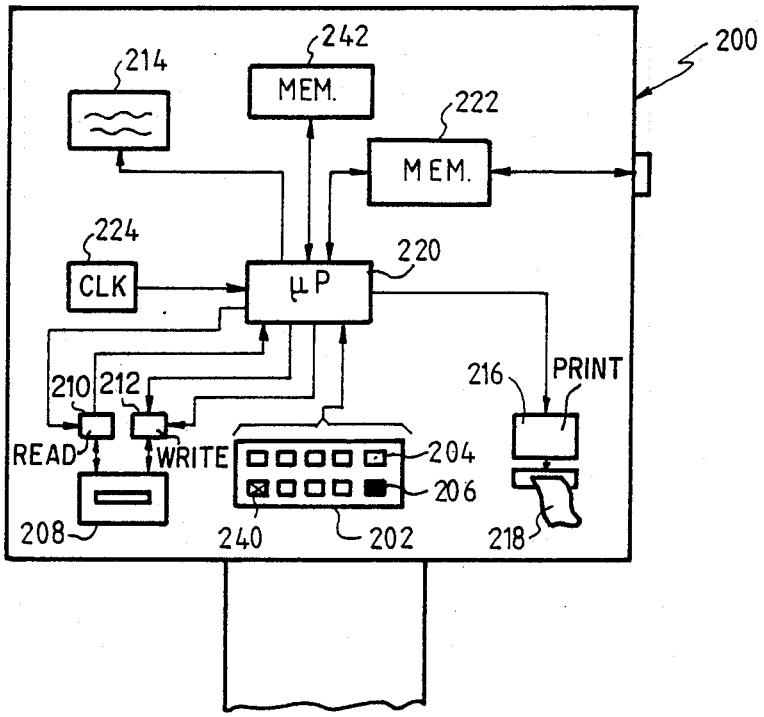
FIG. 4 is a block diagram of a second variant of the first implementation of the invention.

FIG. 4 shows a fourth embodiment of the parking meter according to the invention.

The structure of the parking meter of FIG. 4 is identical to that of FIG. 3. However, FIG. 4 shows separately the memory 242 associated to the microprocessor 220. The program of the microprocessor and some special data are stored in memory 242.

According to this fourth embodiment the parking meter is suitable for operating the memory cards. The card memory is either electronic (integrated circuit) or magnetic (magnetic track).

An identification number is stored in the memory of the card. This identification number is not related to the registration number of the vehicle of the card's user. As a result, this identification number is stored in the card memory before the user purchases his card. Furthermore the memory of the card includes an area for storing data corresponding to amount of money available for paying parking fees. This amount of money is updated each time the card is used by the user until this amount becomes equal to zero.

The operating of the fourth embodiment of FIG. 4 is as follows:

The user inserts his card into the slot 208 of the card reader. The reader control circuit 210 transfers to the microprocessor 220 the identification number and the available balance stored in the card memory. The user keys in the desired parking duration by means of the keyboard 202.

Under the control of the program stored in memory 242, the microprocessor 220 converts the desired parking duration into an amount of parking fees and it compares this amount with the available balance of the card. The display panel 214 displays the parking time limit. The parking time limit corresponds to either the desired parking duration or a reduced parking duration, depending on the result of the comparison between the calculated amount of money and the available balance of the card. The parking time limit is calculated by adding to the parking duration the present time data supplied by the clock circuit 224.

If the user is satisfied with the displayed time limit, he presses the validation key 240. The corresponding signal initiates the performance of another part of the program stored in memory 242. The microprocessor processes the identification number and a number characteristic of the parking meter and stored in memory 242 to elaborate a pseudo random number by performing a predetermined algorithm. According to the next step, the microprocessor 220 activates the printing head 216 in order to print the pseudo random number of a slip and controls the storing of the pseudo random number and the associated parking time limit in the memory 222. As a result, pairs of data are stored in the memory 222, one of these data being the pseudo random number, and the other one being the corresponding authorized parking time limit.

Then the user can take away his memory card and he places the delivered slip immediately behind the windscreen of his vehicle.

At regular time intervals which are defined by the clock circuit 224, the microprocessor 220 reads the pairs of data which are stored in the memory 222. The microprocessor compares each parking time limit with the present time. The pairs of data corresponding to time limits which are anterior to the present time are deleted in the memory 222.

When a user returns to take away his vehicle, two situations may arise. Either the user returns late and the vehicle is already in violation, or else the user returns early and he is authorized to recover any excess payment. This excess payment corresponds to the time difference between the initially paid end of parking and the actual end of parking. In order to do this, the user inserts his card into the card reader 208 and presses the end-of-parking special key 206. The read circuit 220 sends the identification number read from the card to the microprocessor. Then the microprocessor 220 performs the predetermined algorithm to compute the corresponding pseudo random number. The microprocessor checks the pseudo random numbers stored in memory 222 and selects the time limit data corresponding to the computed pseudo random number. Then the microprocessor calculates the time difference between this time limit and the present time and converts this time difference into an amount of parking fees. Then the writing circuit 212 is activated to update the memory of the card in order to pay off the amount of parking fees corresponding to the unused parking duration. Finally the pair of data is deleted in the memory 222.

Considering now the checking of the parked vehicles by the checker, the operating procedure is as follows. The checker connects his portable terminal to the parking meter to copy all the pairs of data which are stored in the memory 222 of the parking meter. When the checker passes in front of a parked vehicle, he keys in the pseudo random number printed on the slip placed behind the windscreen of the vehicle.

Several situations may occur. The first one corresponds to the fact that the read pseudo random number is present in the memory of the portable terminal. In this case the circuits of the terminal compare the corresponding parking time limit with the present time. Depending on the result of this comparison the vehicle is in violation or not. The other situation consists in the fact that the pseudo random number is not present in the memory of the portable terminal. In this second case the circuits of the terminal perform an algorithm which is the reverse one of the algorithm stored in the parking meter memory. The performance of the reverse algorithm gives the identification number and the number characteristic of a parking meter which corresponds to the pseudo random number. The decoded number characteristic of a parking meter is compared with the number characteristic of the parking meter where the pairs of data have been copied. If these numbers are identical, then the display panel of the portable terminal shows a particular information to indicate to the checker that the vehicle is in violation. If the two numbers are different one from the other, it means that the driver of the vehicle paid at a parking meter which is different from the one where the checker copied the pairs of data. Then the pseudo random number and the number of the parking meter are maintained in the memory of the portable terminal, and the checker will check again the vehicle when he connects his terminal at the parking meter having the decoded characteristic number. Moreover if a driver uses a falsified slip, i.e. a slip with a falsified pseudo random number, this situation is automatically detected when the reverse algorithm is performed.

It can thus be seen that the fourth embodiment of the invention requires the use of a slip which is to be placed behind the windscreen of the parked vehicles. However this printed slip is not used to display the authorized parking time limit. The pseudo random number printed on the slip is only used as a vehicle identification information. Another advantage of this embodiment is as follows. When a street is large, several parking meters are settled to control the parking spaces of this street. Consequently a driver who parks his vehicle in this street may use one among several parking meters to insert his card. It means that the data corresponding to the parked vehicle may be stored in one of these parking meters. Because the pseudo random number includes the number of the parking meter where the corresponding data are stored, this problem is solved.

Generally, the authorized parking duration is limited to a maximum time duration, for example, two hours. In this case the key board of the parking meters can be withdrawn. When the user inserts his card into the card reader the processing circuit of the parking meter determines the authorized parking time limit by adding the maximum parking duration to the present time. The total amount of money remaining in the card memory is reduced by the amount required to pay for the maximum parking duration.

When the user wants to take his vehicle away from its parking space, two possible situations may arise, as previously explained: 1 either the user returns after the maximum parking duration has expired and the vehicle is in violation; or else the user returns before the maximum parking duration has expired and can therefore be repaid the excess amount prepaid in the manner described with reference to FIG. 3. In other words the amount remaining in the card memory is increased by an amount corresponding to the unused parking duration.

We claim:

1. A system for controlled metered parking of road vehicles, the system comprising:

a parking meter for controlling a plurality of parking spaces, said meter comprising means accessible to drivers for entering vehicle identity data, means for computing a parking time limit associated with said vehicle identity data as a function of an amount of money prepaid by said drivers, means for storing a plurality of pairs of data items where a first data item of each of said pairs is a particular vehicle identity data item and a second data item of each said pairs is a parking time limit data item associated with said vehicle identity data item, and a first clock for delivering data corresponding to the present time; and a portable terminal for use by a checker of said controlled metered parking, said terminal including means accessible to said checker for entering identification data corresponding to a vehicle parked at a particular one of said parking spaces, a second clock for providing data corresponding to the present time, means for comparing said identification data entered into said portable terminal with said vehicle identity data stored in said parking meter, means for comparing said stored parking time limit data with the present time as delivered by said second clock, and means for processing the results of said comparisons in order to cause a warning signal to appear at said terminal when said stored parking time limit data item corresponding to said parked vehicle has expired.

2. A system according to claim 1, wherein said means for computing a parking time limit further comprises means disposed in said parking meter for periodically reading said parking time limit data items contained in said storage means of said parking meter, means comparing said present time data from said first clock with said parking time limit data items, and means for deleting stored pairs of data items as a function of said comparison.

3. A system according to claim 2, wherein said portable terminal further comprises a memory means disposed in said portable terminal suitable for receiving all of said pairs of data items stored in said storage means of said parking meter, and wherein said comparison means include:

first comparator means disposed in said portable terminal for comparing said identification data entered into said portable terminal with said plurality of pairs of data items contained in said memory means of said terminal; and second comparator means disposed in said portable terminal and activated by said first comparator means for comparing said parking time limit data items in said memory means of said portable terminal with said present time data as delivered by said second clock.

4. A system according to claim 1, wherein said means for entering identity data into said meter comprises a keyboard, and further comprising means for entering data concerning the time limit of authorized parking into said parking meter, said means for entering data concerning the time limit of authorized parking into said parking meter comprising a coin slot, a coin selector for generating a value signal representative of the amount of money inserted in coins, and processor means for determining an authorized parking time limit on the basis of said value signal and of data representative of the present time.

5. The system of claim 4 wherein said processor means is part of said means for computing a parking time limit.

6. The system of claim 4 wherein said processor means is distinct from said means for computing a parking time limit, the output of said processor means being connected to said means for computing a parking time limit whereby said means for computing parking time limit is able to use the output of said processor means to compute said parking time limit data item for each vehicle.

7. A system according to claim 1, wherein said means for entering data into said parking meters comprises:

a keyboard for entering parking duration data corresponding to a requested parking duration; and a device for reading and writing data in a memory medium, said memory medium storing, in normal operation, said vehicle identity data and an amount of money, said device storing a new amount of money on said memory medium as a function of said requested parking duration entered via said keyboard.

8. A system according to claim 7, wherein said parking meter further includes means operable when a driver wishes to end vehicle parking to compare said present time data at the time of reinserting said memory medium into said device for reading and writing data in a memory medium for writing data to said memory medium corresponding to the refund of an unused portion of said requested parking duration if said present time data is prior to said parking time limit data item.

9. A system according to claim 1, further comprising:

means for reading and writing data in a portable data memory medium, said medium having in memory an identification data and an amount of money data, said writing means being suitable for storing in said memory of said portable medium a new amount of money data as a function of a parking duration data;

means for performing a predetermined algorithm in order to provide a pseudo random number as a function of said identification data and a data which is characteristic of the parking meter; and printing means for providing to the driver a printed data support on which said pseudo random number is printed in a visible manner.

10. A system according to claim 9 wherein said parking meter further comprises means for adding to the present time data corresponding to the time when said portable memory medium is inserted into said reading-writing means, a predetermined time duration data, whereby said parking time limit data is provided.

11. A system according to claim 9 wherein said parking meter further includes means, operable when a driver wishes to end vehicle parking, to compare the real end of parking time as indicated by reinserting the data medium into the device with the initially inserted end of parking time, and for writing data to said memory medium concerning the refund of un-used parking time if the real end parking time is sooner than the initially inserted end of parking time.

12. A system according to claim 9 wherein said data entering means further comprise, a keyboard means for entering parking duration data in order to elaborate said parking time limit data.

13. A system for controlling metered parking of road vehicles the system comprising:

a parking meter for controlling a plurality of parking spaces including means accessible to drivers for entering vehicle identity data specific to his vehicle and a parking time limit as a function of an amount of money prepaid, memory means for storing pairs of data items corresponding to vehicle identity and to an associated parking time limit, clock means for delivering data concerning the present time, means for periodically comparing said present time data with said parking time limit and deleting stored pairs of data items from said memory means as a result of said comparison;

a portable terminal for use by a checker, said terminal including means accessible to said checker for entering a vehicle identity data specific to a vehicle actually parked at one of said parking spaces.

means for transmitting to said parking meter an identity signal corresponding to said vehicle identity data entered by said checker, and means for emitting warning information at the receipt of a warning signal; and said parking meter further comprising means for receiving said identity signal, means for comparing vehicle identity data corresponding to said received identity signal with vehicle identity data stored as said pairs of data items in said memory means, means for comparing said associated time limit data with said present time data, and means for processing the results of said comparison and emitting said warning signal if vehicle identity data corresponding to said received identity signal is not stored in said memory means or the vehicle corresponding to said received identity signal is in violation.

14. A system according to claim 13, wherein said means for entering identity data into said parking meter comprises:

a keyboard, and wherein said means for entering data concerning the time limit of authorized parking into said parking meter comprises a coin slot, a coin selector for generating a value signal representative of the amount of money inserted in coins, and processor means for determining an authorized parking time limit on the basis of said value signal and of data representative of the present time.

15. A system according to claim 14, wherein said means for inserting data into said parking meter comprises:

a keyboard for entering parking duration data; a device for reading and writing data in a memory medium said medium storing, in normal operation, a vehicle identity and an amount of money, and said device being disposed to store a new amount of money on said data medium as a function of said parking duration data entered via said keyboard.

16. A system according to claim 13, wherein said vehicle identity data is at least a part of the license number of the vehicle.

17. A system for controlled meter parking of road vehicles, comprising:

a parking meter for controlling a plurality of parking spaces, said meter comprising:

means accessible to drivers for entering a parking duration data as a function of an amount of money prepaid, means for reading and writing data in a portable data memory medium, said medium having in memory an identification data and an amount of money data, means for storing in said memory of said portable medium a new amount of money data as a function of said parking duration data, processing means for performing a predetermined algorithm in order to provide a pseudo random number as a function of said identification data and a data which is characteristic of the parking meter, printing means for providing to the driver a printed data item on which said pseudo random number is printed in a visible manner; and means for storing pairs of data items, wherein a first data item corresponds to said identification data and a second data item corresponds to said parking duration data;

a portable terminal for use by a checker, said terminal including means accessible to said checker for entering a number corresponding to a number displayed on said printed data item on a vehicle actually parked at one of said parking spaces; and said system further including a clock for delivering data corresponding to the present time, means for comparing said number entered into said portable terminal with a number corresponding to said first data item, means for comparing said second data item with the present time as delivered by said clock, and means for processing the results of said comparisons in order to cause a warning signal to appear at said terminal when a parked vehicle whose number displayed on said printed data item has been entered into said terminal is in violation.

18. A system according to claim 17, wherein said parking meter further comprises means for adding said parking duration data to the present time when said portable memory medium is inserted into said reading-writing means, whereby said parking time limit data is provided.

19. A system according to claim 17, wherein said parking meter further includes means, operable when a driver wishes to end vehicle parking to compare the actual end of parking time as indicated by reinserting the data medium into the device with the initially inserted end of parking time, and for writing data to said memory medium corresponding to the refund of unused parking time if the actual end of parking is prior to the initially inserted end of parking.

20. A system according to claim 17, wherein said data entering means further comprises a keyboard for entering parking duration data in order to provide said parking time limit data.

21. A system for controlling metered parking of road vehicles, the system comprising:

a parking meter for controlling a plurality of parking spaces, said meter comprising means accessible to drivers for entering vehicle identity data and a parking time limit as a function of an amount of money prepaid, means for storing pairs of data items corresponding to a vehicle identity and to an associated parking time limit; and a portable terminal for use by a checker, said terminal including means accessible to said checker for entering identification data corresponding to a vehicle actually parked at one of said parking spaces;

said system further including clock means for delivering data concerning the present time, first means for comparing the identity data entered into said portable terminal with the identity data stored in said parking meter, second means for comparing said stored parking time limit data with the present time as delivered by said clock, and means for processing the results of said comparisons in order to cause a warning signal to appear at said terminal when a parked vehicle whose identity data has been entered into said terminal is in violation.

22. A system according to claim 21, wherein said clock means includes first clock means located in said parking meter and wherein said second comparison means and said processor means comprise means disposed in said parking meter for periodically reading the parking time limit contained in the storage means of said parking meter, for comparing the present time therewith, and for deleting stored pairs of data items as a function of said comparison.

23. A system according to claim 22, wherein said processor means further include:

means contained in said portable terminal for transmitting a first signal representative of an input identity data item;

means contained in said parking meter for receiving said first signal and for applying the data contained therein to said first comparison means;

means contained in said parking meter for transmitting a warning signal if the entered identity data is not contained in the storage means of said terminal; and means contained in said portable terminal for receiving said warning signal.

24. A system according to claim 21, wherein said clock means includes first clock means disposed in said parking meter and second clock means disposed in said portable terminal wherein said portable terminal further comprise a memory disposed in said portable terminal suitable for receiving all of said pairs of data items stored in the memory of said parking meter and wherein said first comparator means are disposed in said portable terminal for comparing the entered identity data with the entire set of identity data items contained in the memory of said terminal, and said second comparator are means disposed in the terminal and activated by said first comparator means for comparing an authorized parking time limit data item stored in the memory of said portable terminal with the present time as delivered by said second clock means.

25. A system according to claim 21, wherein said clock means includes first clock means located within said parking meter and wherein said means for entering identity data into said parking meter comprise a keyboard, and wherein said means for entering data concerning the time limit of authorized parking into said parking meter comprise a coin slot, a coin selector for generating a value signal representative of the amount of money inserted in coins, and calculating means for determining an authorized parking time limit on the basis of said value signal and of said data concerning the present time delivered by said first clock means.

26. A system according to claim 21, wherein said clock means include first clock means located within said parking meter and wherein said means for entering data into said parking meter comprise:

a keyboard for entering parking duration data;

calculating means for determining an authorized parking time limit on the basis of said parking duration data and the present time data delivered by said first clock means; and a device for reading and writing data in a memory medium, said medium storing, in normal operation, a vehicle identity and an amount of money, and said device being disposed to store a new amount of money on said data medium as a function of a requested parking duration entered via said keyboard.

27. A system according to claim 26, wherein said parking meter further includes means, operable when a driver wishes to end vehicle parking, to compare the real end of parking time as indicated by reinserting the data medium into the device with the initially inserted end of parking time, and for writing data to said memory medium concerning the refund of un-used parking time if the real end of parking is sooner than the initially inserted end of parking.

28. A system according to claim 21, wherein said clock means include first clock means located within said parking meter and wherein said means for entering data in said parking meter comprise:

means for reading and writing data in a portable data memory medium, said medium having in memory an identification data and an amount of money data, for storing in said memory of said portable medium a new amount of money data as a function of a parking duration data, additional processing means for performing a predetermined algorithm in order to elaborate a pseudo random number as a function of said identification data and a data which is characteristic of the parking meter, said pseudo random number being said vehicle identity data, and calculating means for determining authorized parking time limit on the basis of said parking duration data and the present time data delivered by said first clock means, said parking meter further comprising printing means for providing to the driver a printed data support on which said pseudo random number is printed in a visible manner.

29. A system according to claim 28 wherein said parking meter further includes means, operable when a driver wishes to end vehicle parking to compare the real end of parking time as indicated by reinserting the data medium into said means for reading and writing data with the initially entered end of parking time, and for writing data to said memory medium concerning the refund of un-used parking time if the real end of parking is sooner than the initially entered end of parking.

30. A system according to a claim 28, wherein said data entering means further comprise, a keyboard means for entering parking duration data in order to elaborate said parking time limit data.

31. A system according to claim 28 wherein said parking meter further comprises means for adding to the present time data corresponding to the time when said portable memory medium is inserted into said reading-writing means, a predetermined time duration data, whereby said parking time limit data is provided.

32. A system for controlling metered parking of road vehicles the system comprising:

a parking meter for controlling a plurality of parking spaces including means accessible to drivers for entering vehicle identity data and a parking time limit as a function of an amount of money prepaid;

memory means for storing pairs of data items corresponding to vehicle identity and to an associated parking time limit and clock means for delivering data concerning the present time; and a portable terminal for use by a checker, said terminal including means accessible to said checker for entering a vehicle identity data corresponding to a vehicle actually parked at one of said parking spaces;

means for transmitting towards said parking meter an identity signal representative of said entered vehicle identity data; and means for emitting a warning information at the receipt of a warning signal;

means for receiving said identity signal corresponding to a vehicle identity data; and means for comparing said received vehicle identity data with the vehicle identity data stored in said memory means, means for comparing the associated time limit data with the present time data, and means for processing the results of said comparisons for emitting said warning signal if the received vehicle identity data is not stored in said memory means or the vehicle corresponding to said received vehicle identity data is in violation.

33. A system according to claim 32, wherein said means for entering identity data into said parking meter comprise a keyboard, and wherein said means for entering data concerning the time limit of authorized parking into said parking meter comprise a coin slot, a coin selector for generating a value signal representative of the amount of money inserted in coins, and processor means for determining an authorized parking time limit on the basis of said value signal and of data representative of the present time.

34. A system according to claim 32, wherein said means for entering data into said parking meter comprise:

a keyboard for entering parking duration data; and a device for reading and writing data in a memory medium said medium storing, in normal operation, a vehicle identity data and an amount of money, and said device being disposed to store a new amount of money on said data medium as a function of a requested parking duration entered via said keyboard.

35. A system according to claim 32, wherein the vehicle identity data is specific to the vehicle.

36. A system according to claim 35, wherein the vehicle identity data is at least a part of the license number of the vehicle.

* * * * *